United States Patent [19]

Powell

[11] 3,954,235

[45] May 4, 1976

[54] KITES

[76] Inventor: Peter Trevor Powell, 2, Robertson Road, Shurdington, Cheltenham, England

[22] Filed: Aug. 21, 1974

[21] Appl. No.: 499,282

[30] Foreign Application Priority Data

Aug. 28, 1973 United Kingdom ..... 40445/73

[52] U.S. Cl. ..... 244/153 R

[51] Int. Cl.[2] ..... B64C 31/06

[58] Field of Search ..... 244/153–155

[56] References Cited

UNITED STATES PATENTS

| | | | |
|---|---|---|---|
| 1,029,010 | 6/1912 | Guillo | 244/153 R |
| 1,666,813 | 4/1928 | Eddy | 244/154 |
| 1,892,985 | 1/1933 | Hughes | 244/153 R |
| 2,785,870 | 3/1957 | Green | 244/153 R |
| 3,018,075 | 1/1962 | Bowers | 244/153 R |
| 3,116,902 | 1/1964 | Gould | 244/153 R |
| 3,276,730 | 10/1966 | Cleveland | 244/153 R |
| 3,315,922 | 4/1967 | Hull | 244/153 R |
| 3,615,064 | 10/1971 | Gellert | 244/153 R |

FOREIGN PATENTS OR APPLICATIONS

| | | | |
|---|---|---|---|
| 81,316 | 8/1894 | Germany | 244/153 R |

*Primary Examiner*—Trygve M. Blix
*Assistant Examiner*—Galen L. Barefoot
*Attorney, Agent, or Firm*—Oblon, Fisher, Spivak, McClelland & Maier

[57] ABSTRACT

A kite comprises sheeting spread by a longitudinal spar and a lateral spar disposed one on each side of the sheeting. The lateral spar is formed in two spaced parts which are connected by a spring wire attached to the longitudinal spar. The outer ends of the lateral spar are attached to bracing members extending along the leading edges of the kite and the spring wire acts to control the relative inclination of what amounts to two wings of the kite.

4 Claims, 4 Drawing Figures

KITES

This invention relates to kites and comprises improvements in or modifications of the kite described and claimed in British Pat. No. 1,267,933.

Kites of the kind comprising sheeting spread by crossed spars substantially in the plane of the sheeting need to withstand a wide range of wind speeds and pressures, and to withstand gusts of wind in steady flight and in rapid climb and sideways movement. Design to meet the maximum stresses to be encountered and at the same time to achieve light weight in the structure and tethering line presents difficulties and tends to lead to the choice of expensive materials for high-performance kites.

It is an object of the invention to reduce the stresses in flight and so to permit the use of lighter structure and tethering lines and/or cheap materials for better performance in a given class of kite. The invention in one aspect provides improved spring hinging of a lateral spar and in another aspect an improved disposition of that spar to control leading edges of the kite to attain kite constructions offering stable and controlled flight as well as reduced stresses.

In one aspect of the invention, a kite comprises sheeting spread by a pair of crossed spars one of which is in two parts hingedly connected together by spring means in the form of a resilient flexible member attached to the other spar to allow the two parts to move relative to each other under wind pressure against the action of the spring means.

The crossed spars in the preferred form comprise a longitudinal or backbone spar and a lateral spar, the latter being in two parts of equal length joined together by the resilient flexible member which crosses the longitudinal member and is fixed thereto to provide for relative angular movement of the two parts as wing struts. For the control of the kite, a separate tethering loop may be provided for each of the two parts.

The resilient flexible member may be a length of spring wire or strip and for the fixing of the lateral spar to the backbone a bracket, particularly a tubular plastics stub, may be used having spaced through-holes in which the backbone spar and the wire or strip fit tightly at right angles.

The lateral flexing spar is preferably connected between intermediate points of bracing members which extend along leading edges of the sheeting from flexible joints at the head end of the backbone spar.

Hence, in another aspect of the invention, a kite comprises sheeting spread by a longitudinal backbone spar and a pair of wing struts of equal length resiliently connected together to form a lateral spar capable of flexing movement about the longitudinal spar, the lateral spar being connected between intermediate points of bracing members which extend along leading edges of the sheeting from flexible joints at the head end of the longitudinal spar.

A kite embodying the invention will now be described by way of example and with reference to the accompanying drawings, in which.

Figure 1:
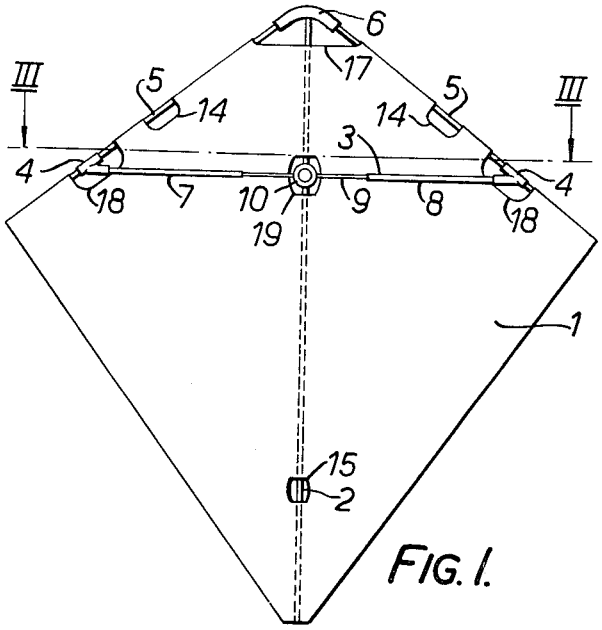
FIG. 1 is a face view of the kite.

The kite sheeting 1, which may be, for example, of polythene or fabric, is spread by means of a longitudinal backbone spar 2 and a flexible lateral spar 3 fixed between brackets 4 at intermediate points along bracing rods 5 which extend along the leading edges of the kite.

The bracing rods 5 are flexibly attached to the head end of backbone 2 by force fitting in the ends of a short length of flexible plastic tubing 6 transfixed by the backbone 2. The lateral spar 3 comprises two rods 7 and 8 joined together by a central rod 9 of steel wire forming a spring hinge. The spring steel rod 9 is force fitted in bores at the inner ends of the rods 7 and 8 which may carry ferrules or bindings (not shown) to prevent splitting. The brackets 4 between which the lateral spar 3 is fitted are plastic mouldings each having a sleeve portion housing the bracing rod 5 and a branching sleeve housing an end of the rod 7 or 8, all force fitted.

Figure 2:
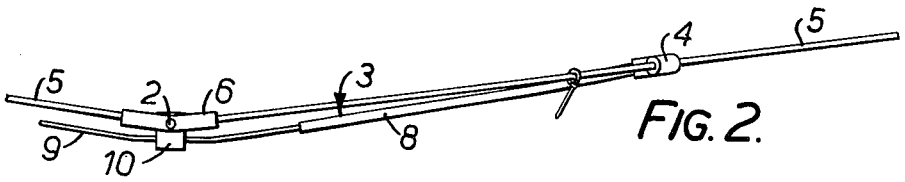
FIG. 2 is a partial head-on view of the kite.
Figure 3:
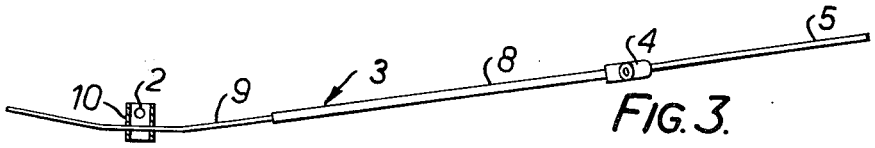
FIG. 3 is a view on the line III—III of FIG. 1.

The lateral spar 3 is centrally fixed to and slightly offset from the backbone 2 at the crossing of these parts. For this purpose a plastic stub 10, preferably tubular as shown, has a diametrical bore force fitting the backbone 2 therein, and a finer diametrical bore housing the spring steel rod 9. The latter is set with a small central curvature and thus the lateral spar 3 serves as two flexibly connected wing struts which spread the sheeting 1 in two back-inclined wing portions on either side of the backbone 2 as clearly seen in FIGS. 2 and 3.

Figure 4:
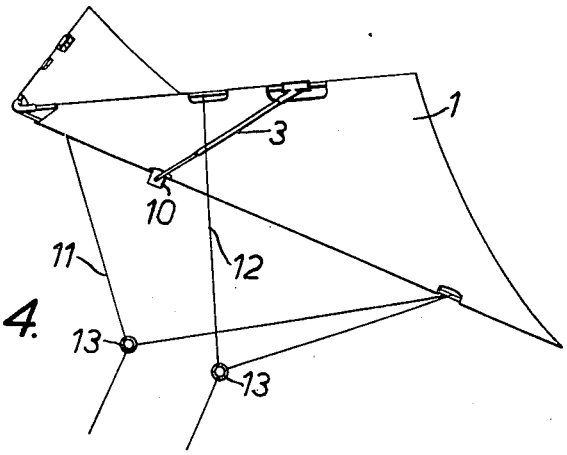
FIG. 4 illustrates the kite in flying attitude.

Two separate tethering lines 11 and 12 are provided, one for each wing portion, as shown in FIG. 4. Each line has a ring for a kite string and extends from a point in the corresponding bracing rod 5 above the bracket 4 to the backbone 2 near the bottom end thereof. Cutouts 14 and 15 (FIG. 1) in the sheeting 1 facilitate attachment of the line ends and identify the attachment points.

All of the parts of the kite except the lateral spar 3 are normally provided and retained in an assembled state, the sheeting 1 having leading edge seams housing the rods 5 and being further cut away at 17, 18 and 19 to expose the flexible head coupling 6, the brackets 4 and the stub 10 respectively. The bottom end of the backbone is held in a pocket in the sheeting, formed for example by wrapping the sheeting, reinforced by adhesive tape, around a dowel pin transfixed by the end of the backbone. For stowage and transit, the leading-edge rods 5 are folded against the backbone 2 about the coupling 6, and the folds of the sheeting are wrapped around backbone and rods 5 for accommodation in a stowage tube, for example of polythene or cardboard.

In order to complete the assembly of the kite for flying, the three-piece lateral spar 3 (which for stowage can be wrapped alongside the backbone) is taken apart, the spring rod 9 threaded through the stub 10 and the pieced assembled together again with the ends of rods 7 and 8 pushed into brackets 4. Hence the backbone 2 lies to the rear of the sheeting, the leading-edge rods 5 generally in the wing planes of the sheeting and the lateral spar 3 to the front of the sheeting together with the tethering lines. The coupling 6 then provides a carrying handle.

Although for the flying of the kite, a single kite string may be tied to both of the rings 13, two separate strings, one to each ring, provide control by which the kite can be caused to execute a variety of maneuvers. The kite readily rises from the ground in light wind with the strings already extended and for recovery can be flown back to the ground. The wings yield to increasing air pressure and hinge backwardly against the restoring force of the spring so that neither the operator nor the structural members of the kite are overstressed. The yielding makes for stable flying and gives directional control to the operator.

Hardwood dowel rods are suitable for the spars of kites up to two meters in backbone length but metal tubing can be used for such kite sizes and for larger sizes. It will be appreciated that in some cases triangulated, braced or other composite structures are appropriate as spars, particularly for the backbone. In the illustrated embodiment, a backbone length of 1.2 to 1.5 meters is convenient with a total span approaching the length and a spring steel rod 9 of about 14 gauge or 2.5 mm. diameter.

In a variant construction, the bracing members 5 for the leading edges, and also the flexible joint 6 and brackets 4, are omitted. The span is somewhat reduced and the lateral spar 3 engages in pockets at the side aspices of the sheeting.

What I claim is:

1. A kite comprising:

sheeting spread by means of a longitudinal spar and a lateral spar, said spars being disposed upon opposite sides of said sheeting;

said lateral spar comprising two portions laterally spaced apart from each other;

a laterally extending rod-like spring member interposed between and interconnecting said lateral spar portions, the ends of said spring member being fixedly secured within bores of said spar portions; and bracing members extending solely along the leading edges of said sheeting and flexibly connected to the forward end of said longitudinal spar, said lateral spar extending between and connected at intermediate points of said bracing members.

2. A kite as set forth in claim 1, further comprising:

an aperture defined within said sheeting at the point of intersection of said spars; and a connector member disposed within said aperture and being provided with relatively inclined bores through which said longitudinal spar and said spring member are disposed.

3. A kite as set forth in claim 1, further comprising:

separate tethering lines connected to said bracing members and having ring members disposed thereon for connection with a kite string.

4. A kite according to claim 2, wherein the connector member is a tubular plastic stub and in which the relatively inclined bores are spaced longitudinally of the stub and are at right angles to one another.

* * * * *